US006494120B1

(12) United States Patent
Barbulescu et al.

(10) Patent No.: US 6,494,120 B1
(45) Date of Patent: Dec. 17, 2002

(54) BOLT AND NUT DISASSEMBLING APPARATUS

(75) Inventors: Adrian Barbulescu, Coquitlam (CA); Rodrigue Boulet, Québec (CA); Paul Michaud, Ancienne Lorette (CA); Réal Larochelle, Ancienne-Lorette (CA)

(73) Assignee: Centre de Recherche Industrielle du Quebec, Montreal (CA)

( * ) Notice: Subject to any disclaimer, the term of this patent is extended or adjusted under 35 U.S.C. 154(b) by 0 days.

(21) Appl. No.: 09/671,272

(22) Filed: Sep. 28, 2000

(30) Foreign Application Priority Data

Sep. 29, 1999 (CA) ..... 2284352

(51) Int. Cl.[7] ..... B25B 21/00

(52) U.S. Cl. ..... 81/57.42; 81/57.14; 81/57.24

(58) Field of Search ..... 81/57.42, 57.14, 81/57.24, 57.4, 57.43, 54, 52, 124.1

(56) References Cited

U.S. PATENT DOCUMENTS

| | | | | |
|---|---|---|---|---|
| 4,106,371 A | * | 8/1978 | Akiyoshi et al. | 81/57.14 |
| 4,265,147 A | | 5/1981 | Fox | |
| 4,271,730 A | | 6/1981 | Hoell et al. | |
| 4,498,545 A | | 2/1985 | Grassi et al. | |
| 5,245,895 A | | 9/1993 | Yoshida et al. | |
| 5,301,574 A | | 4/1994 | Knopp et al. | |
| 5,357,828 A | | 10/1994 | Spirer | |
| 5,390,568 A | | 2/1995 | Pietras | |
| 5,515,752 A | * | 5/1996 | Sawano et al. | 81/57.4 |
| 5,544,554 A | | 8/1996 | Brightly | |
| 5,690,005 A | | 11/1997 | Jung et al. | |
| 5,692,418 A | | 12/1997 | Burner | |

OTHER PUBLICATIONS

CRIQ's Annual Report 1992–1993, 4 pages (with English translation).

CRIQ, 3 pages, "Mechanized Nut Remover", Mar. 1999 (with English translation).

* cited by examiner

*Primary Examiner*—D. S. Meislin
(74) *Attorney, Agent, or Firm*—Oblon, Spivak, McClelland, Maier & Neustadt, P.C.

(57) ABSTRACT

A apparatus for disassembling a threaded bolt and nut assembly wherein the bolt is initially extended through an opening provided on a structure and being secured thereto with the nut axially mounted on a threaded rod of the bolt. The apparatus comprises a tool body, a nut gripping element such as a socket mounted for rotation on a working portion of the tool body, the socket being provided with a bore axially extending theretrough. The apparatus further comprises a rotary actuator mounted on the tool body and operatively coupled to the socket for imparting torque to the mounted nut in a direction allowing release of the nut from the secured bolt. The apparatus also comprises a pushing device such as a pneumatic power hammer mounted on the tool body and provided with an elongated push member having a working end being axially displaceable within the bore, and a linear actuator mounted on the tool body and operatively coupled to the hammer for selectively displacing the push member between a retracted position allowing the release of the mounted nut and an extended position where the bolt is at least partially withdrawn from said opening upon thrust of the working end of the push member. A pneumatic control system is provided for controlling the rotary actuator and the linear actuator. The apparatus can be provided with a base for supporting the tool body and a holder connecting the base to the tool body while allowing transversal displacement thereof on the holder. A first embodiment uses a base provided with a rotary arm, while a second embodiment uses a base provided with a displaceable carrier mounted on a rail.

12 Claims, 7 Drawing Sheets

194
192
194'
192'
190
188
188'
198
156
196
153'
149
155
153
196'
154
149'
166
148
151
160
151'
146
147
199
138
147'
145
144
143
141
167
139
150
152
140
170
162
21
134
164
168
136
173'
173
132
172
116
184
35
131
128
182
110
180
108
114
174
124
126
176
122
130
178
120
118
112
106
87
105
85
104
142
87
102
100
98
96
75
94
92
93
89
91
85

BOLT AND NUT DISASSEMBLING APPARATUS

FIELD OF THE INVENTION

The present invention relates to the tooling field, and more particularly to tools used for disassembling bolt and nut assemblies.

BACKGROUND OF THE INVENTION

Power torque wrenching tools have been known and used for years in manufacturing and maintenance industries to replace manual tools such as hand wrenches used for installation and removal of bolt and nut assemblies commonly employed for securing various parts together. Typically, power torque wrenches are provided with a rotary holder adapted to receive a selected socket or gripper designed to fit with the outer surface of the nut or bolt head to be tightened or removed from a secured structure. Known power torque wrenches, either be powered through pneumatic, hydraulic or electrical energy, are generally provided with a suitable mechanical or electrical switching device to allow either assembly or disassembly functions. For the particular case of nut and bolt assemblies, a nut can be either tightened on or removed from a corresponding nut, respectively. Examples of such prior art tools are disclosed in U.S. Pat. No. 5,301,574 to Jung et al. and in U.S. Pat. No. 5,357,828 to Spirer. In order to facilitate the use of heavy torque wrenching tools by operators, many tool holders have been proposed for that purpose, examples of which are disclosed in U.S. Pat. No. 4,265,147 to Fox; U.S. Pat. No. 4,271,730 to Holl et al.; U.S. Pat. No. 4,498,545 to Grassi et al.; U.S. Pat. No. 5,245,895 to Yoshida et al.; U.S. Pat. No. 5,390,568 to Pietras; U.S. Pat. No. 5,544,554 to Brightly; U.S. Pat. No. 5,692,418 to Burner; and U.S. Pat. No. 5,690,005 to Jung et al.

In many applications, a complete disassembly of bolts and corresponding nuts mounted on a receiving structure is required, in order to allow further operations, such as disassembly of the structure. For a structure where bolt heads are hidden, the operation involves removal of each nut from the threaded rod of a corresponding bolt protruding from the structure. Then, there is a need to withdraw the bolt by axially pushing it throughout the structure, which bolt is expulsed from the hidden side of the structure. For example, such procedure is required for the maintenance of crushing mills used in the mining industry, wherein worn crushing liners bolted through the inner walls of the mill crushing tumbler have to be periodically replaced. In such a case, following the removal of a nut from a corresponding bolt, the latter is generally jammed and therefore cannot be easily removed by the operator, mainly due to corrosion and dirt accumulation at the interface between the bolt and the material defining the receiving opening provided on the structure. The use of a separate manual tool, and preferably a heavy power tool such as a hydraulic or pneumatic percussion hammer is then required to complete the disassembly, requiring further hard tool handling from the operator while reducing working productivity.

SUMMARY OF THE INVENTION

It is therefore an object of the present invention to provide an apparatus for disassembling a threaded bolt and nut assembly which facilitates both nut removal and bolt removal from a receiving structure.

According to the above object, there is provided an apparatus for disassembling a threaded bolt and nut assembly, the bolt initially extending through an opening provided on a structure and being secured thereto with the nut axially mounted on a threaded rod of said bolt. The apparatus comprises a tool body, a nut gripping element mounted for rotation on a working portion of the tool body, the gripping element being provided with a bore axially extending theretrough. The apparatus further comprises a rotary actuator mounted on the tool body and operatively coupled to the nut gripping element for imparting torque to the mounted nut in a direction allowing release of the nut from the secured bolt. The apparatus also comprises a pushing device mounted on the tool body and provided with an elongated push member having a working end being axially displaceable within the bore, and a linear actuator mounted on the tool body and operatively coupled to the pushing device for selectively displacing the push member between a retracted position allowing the release of the mounted nut and an extended position where the bolt is at least partially withdrawn from said opening upon thrust of the working end of the push member. Means are also provided for controlling the rotary actuator and the linear actuator.

BRIEF DESCRIPTION OF THE DRAWINGS

Preferred embodiments of an apparatus according to the present invention will now be described in detail with reference to the accompanying drawings in which.

DETAILED DESCRIPTION OF THE PREFERRED EMBODIMENTS

Figure 1:
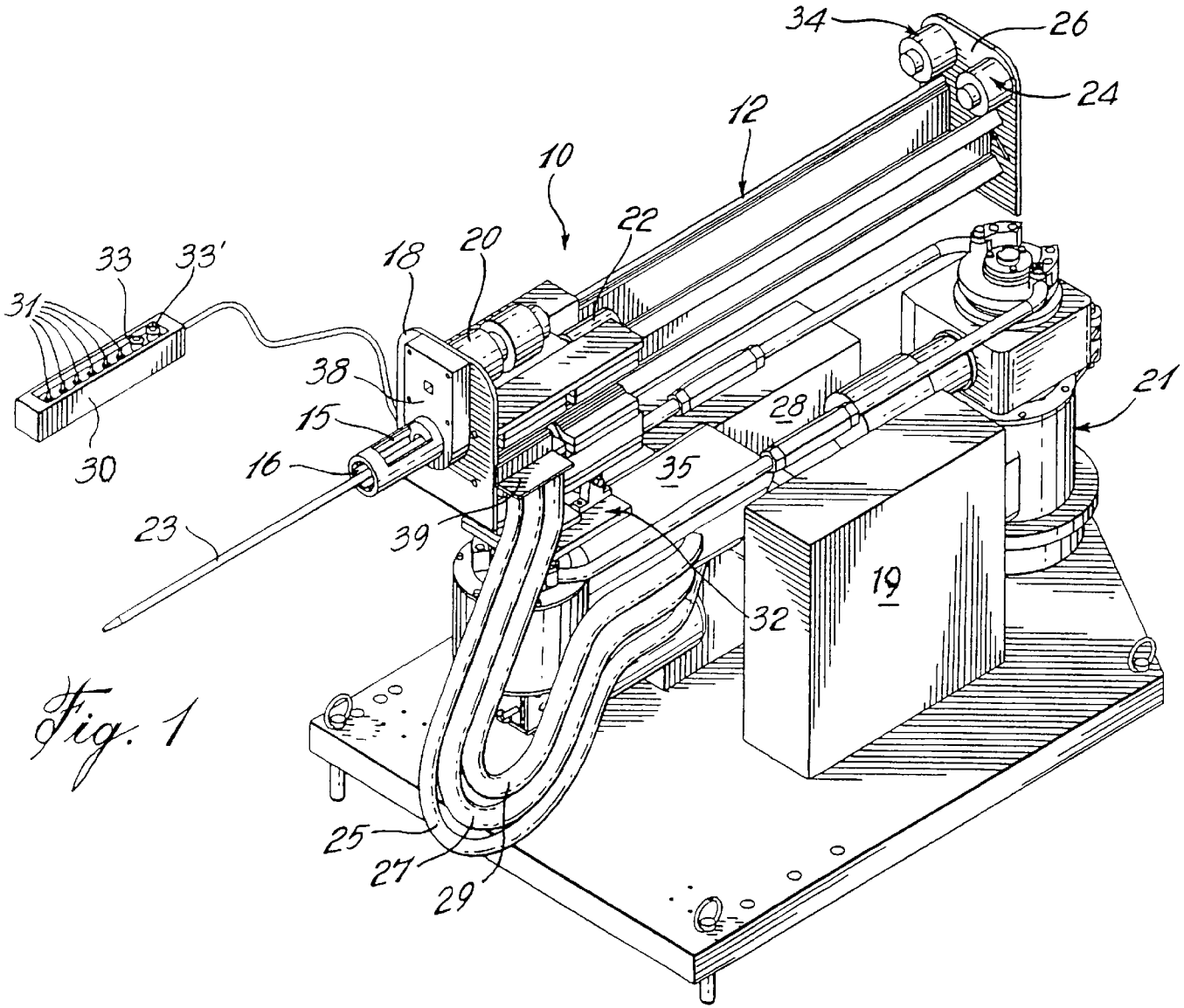
FIG. 1 is a right front perspective view of a first embodiment of an apparatus according to the invention which is mounted on a rotary base.

Referring now to FIG. 1, a first embodiment of a bolt and nut disassembling apparatus generally designated at 10 comprises a tool body 12 and a nut gripping element in the form of a nut socket 14 mounted for rotation on a front working portion of the tool body 12, which nut socket 14 is provided with a bore 16 axially extending therethrough and having a cross-sectional shape designed to fit with the outer surface of a standard hexagonal nut (not shown) to be removed. The nut socket 14 is preferably made changeable, selected from a plurality of such sockets presenting different bore dimensions adapted to fit on nuts of various sizes. Any other suitable gripping element such as jaw-type or toothed grippers may be used. The socket 14 is provided with a lateral opening 15 to allow withdrawal of the nut after release thereof. Mounted on a front plate 18 as part of the tool body 12 is a pneumatic rotary actuator 20 operatively coupled to the nut socket 14, for imparting torque to a mounted nut in a direction allowing release of the nut from a secured bolt. The rotary actuator 20 is preferably reversible to allow an additional nut tightening function. A pushing device in the form of a power hammer 22 which is preferably of a pneumatic type is mounted on the tool body 12 and provided with an elongated push member in the form of a push rod 23 having a working end being axially displaceable within the bore 16 of the nut socket 14, as will be later described in more detail. A first linear actuator generally designated at 24 mounted on a rear plate 26 as part of the tool body 12 is operatively coupled to the power hammer 22 for selectively displacing the push rod 23 either in a forward or backward direction, as will be explained later in more detail. A control system for rotary actuator 20, linear actuator 24 and hammer 22 is also provided, which is preferably of a pneumatic type for simplicity and convenience. However, other control designs based on alternate power sources such as hydraulic or electrical power supplies may be used. The control system includes an air power unit 19 supplying high pressure air and optional low pressure air to a valves unit 28 connected to a remote control device 30 provided with three-position (off, forward, reverse) switches 31 for commanding operation of the various actuators, and optional pushbutton switches 33 and 33' for selection of the pressure level and the automatic sequence. The valves unit 28 is in turn connected to the actuators 20 and 24 through two pairs of air pressure hoses for providing forward and reverse operations, and optional low air pressure hoses allowing fine displacement control, all of which hoses are contained within protective flexible ducts 25 and 27 passing through an input connecting plate 39. Although the valve unit 26 conveniently comprises valves that can be independently commanded by an operator through switches 31 provided on the remote control device 30, the valves unit 28 may include a valves sequence controller of a conventional design for providing automatic operation of the tool, using a set of control air hoses contained within a further flexible protective duct 29. While the apparatus according to the present invention may be designed as a compact hand tool for disassembling small bolt and nut assemblies by providing suitable handle means, the apparatus 10 preferably comprises a base generally designated at 21 having an arm 35 for supporting the tool body 12 and a holder generally designated at 32 connecting the base to the tool body 12 while allowing transversal displacement thereof on the holder 32, as will be described later in more detail. Also mounted on the rear plate 26 is a further linear actuator generally designated at 34 which is also rigidly connected to the holder and operatively coupled to the main body 12 to provide the transversal displacement of the tool body on the holder 32 between a tool body retracted position and a tool body extended position. The actuator 34 is also pneumatically linked to the control valve unit 28 through a pair of corresponding hoses contained in the duct 25 to provide remote operation via the control device 30.

Figure 2:
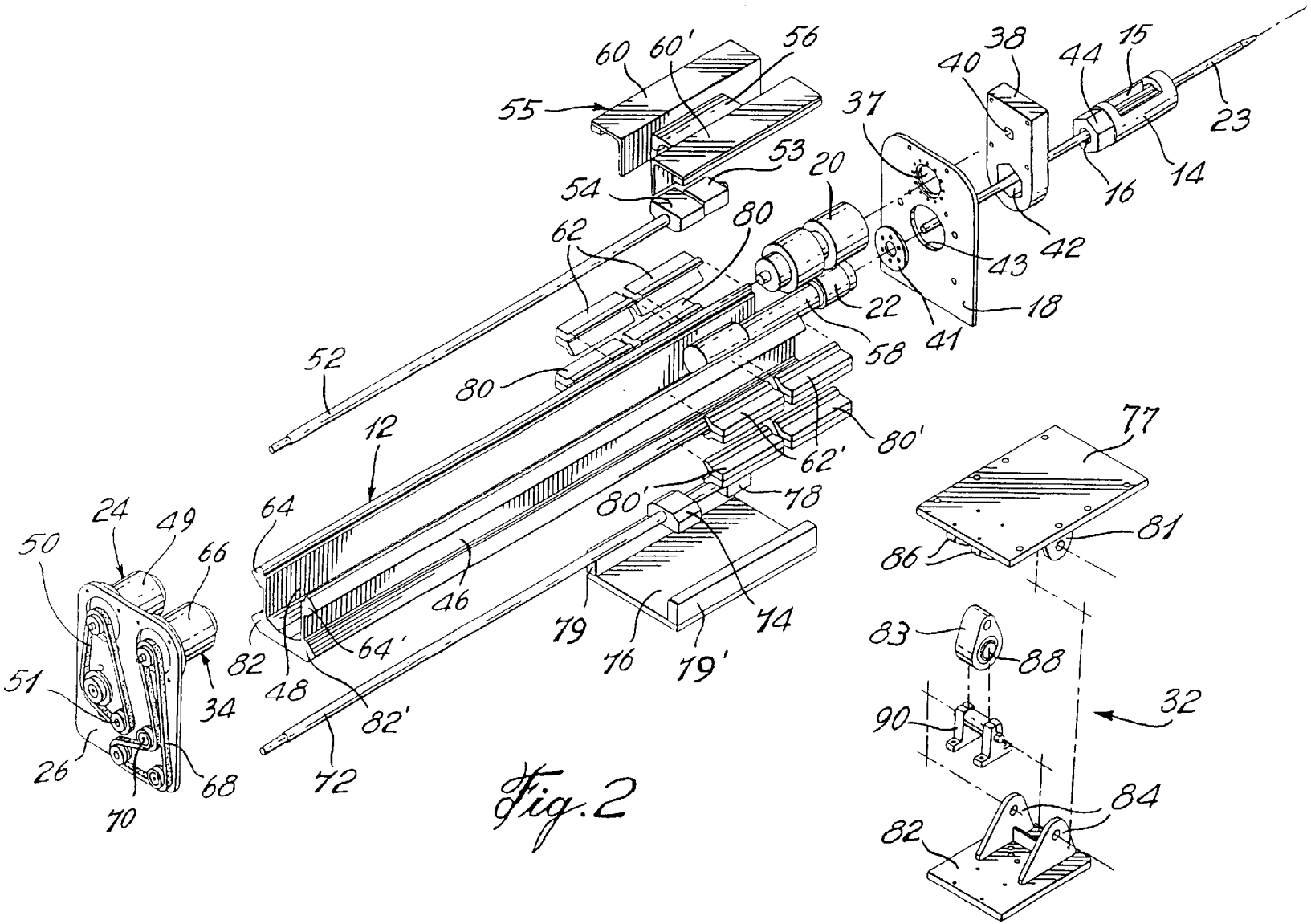
FIG. 2 is a left rear exploded view of the tool provided on the embodiment of FIG. 1.

Referring now to FIG. 2, a further detailed description of the tool portion of the apparatus will now be provided, in which FIG. 2 the control system and the various fasteners used in the assembly of the tool are not shown for the sake of clarity. A first hole 37 is provided on the upper portion of the front plate 18, which hole 37 is provided with inner guide threads adapted to receive a corresponding threaded end portion (not shown) provided on the actuator 20, which is then rigidly bolted on inner side of the front plate 18. Secured on the outer side of front plate 18 is a mismatch gear coupling device 38 having a driven end input 40 adapted to receive an output shaft (not shown) provided on the rotary actuator 20 and extending through the hole 37 in a parallel relationship with the push rod 23, and a driving end output 42 defining a bore exhibiting an hexagonal cross-sectional shape adapted to mate with a corresponding hexagonal base 44 formed in the nut socket 14, to impart torque thereto while allowing the axial displacement of the push rod 23 through the driving end output 42. A ring 41 adapted to fit within a hole 43 provided on the front plate 18 is used to secure the socket base 44 within the driving end output 42, while allowing passage of the push rod 23 through the front plate 18. An elongated section 46 as part of the tool body 12 defines a longitudinally extending channel 48 axially aligned with ring 41, hole 43, end output 42 and socket bore 16, to receive and allow displacement of the hammer 22 through the channel 48 upon operation of the linear actuator 24. For that purpose, the linear actuator 24 includes a pneumatic reversible rotary motor 49 coupled through a first chain and sprocket rollers arrangement 50 to a first rod end bearing element 51 receiving a first end of a first elongated threaded output shaft 52 on which is mounted for relative displacement thereon a threaded attachment 54. The other end of output shaft 52 is mounted on a second rod end bearing element 53 adapted to be secured on the inner side of plate 18 under hole 43 thereof. The attachment 54 is in turn secured to a movable carrier 55 having a central member 56 formed by two joined U-shaped sections adapted to tightly fit over a corresponding recessed central portion 58 of the hammer 22. The movable carrier 55 also has a pair of flanged sections 60 and 60' that are laterally secured to central member 56, which sections 60, 60' are also secured to corresponding sets of upper sliders 62 and 62' respectively. Upper opposed edges of the elongated section 46 form a pair of upper guides 64 and 64' along which sliders 62 and 62' move upon operation of the linear actuator 24, causing the push rod 23 to be displaced between retracted and extended positions. For effecting transversal displacement of the tool body 12 on the holder 32, the linear actuator 84 also includes a pneumatic reversible rotary motor 66 coupled through a second chain and sprocket rollers arrangement 68 to a third rod end bearing element 70 receiving a first end of a second elongated threaded output shaft 72 which is linked to a corresponding threaded attachment 74 rigidly secured to a U-shaped mounting plate 76 as part of the holder 32. The other end of the output shaft 72 is mounted on a fourth rod end bearing element 78 adapted to be secured on the inner side of plate 18 under the second end bearing element 53. The mounting plate 76 is provided with a pair of upwardly flanged elements 79 and 79' that are secured to corresponding sets of lower sliders 80 and 80' respectively. The lower portion of the elongated section 46 forms a pair of lower guides 82 and 82' enabling the section 46 to move on sliders 80 and 80' upon operation of the linear actuator 34, to provide the transversal displacement of the tool body 12 on the holder 32 between a tool body retracted position and a tool body extended position. The mounting plate 76 is secured to an adjustable tilt support as part of the holder 32 which includes a tilting plate 77 receiving the mounting plate 76 and provided with a first pair of underneath spaced perforated flanges 81, a lower support plate 82 provided with a pair of top spaced perforated flanges 84 adapted to be linked to the flanges 81 with a first pivot rod (not shown) extending therethrough. The holder 32 further comprises an eccentric tilt adjustment mechanism including a cam 83 having an upper end being mounted under the tilting plate 77 with a second pivot rod (not shown) extending through a second pair of underneath spaced perforated flanges 86 provided on the tilting plate 80, an a lower end mounted with an anti-vibration sleeve 88 to a connecting bridge 90 secured to the lower support plate 82. In this manner, the holder 32 is pivotally mounted on the base 21 to allow adjustment of relative angular position of the tool body 12 in a vertical plane with respect to the base 21.

Figure 3:
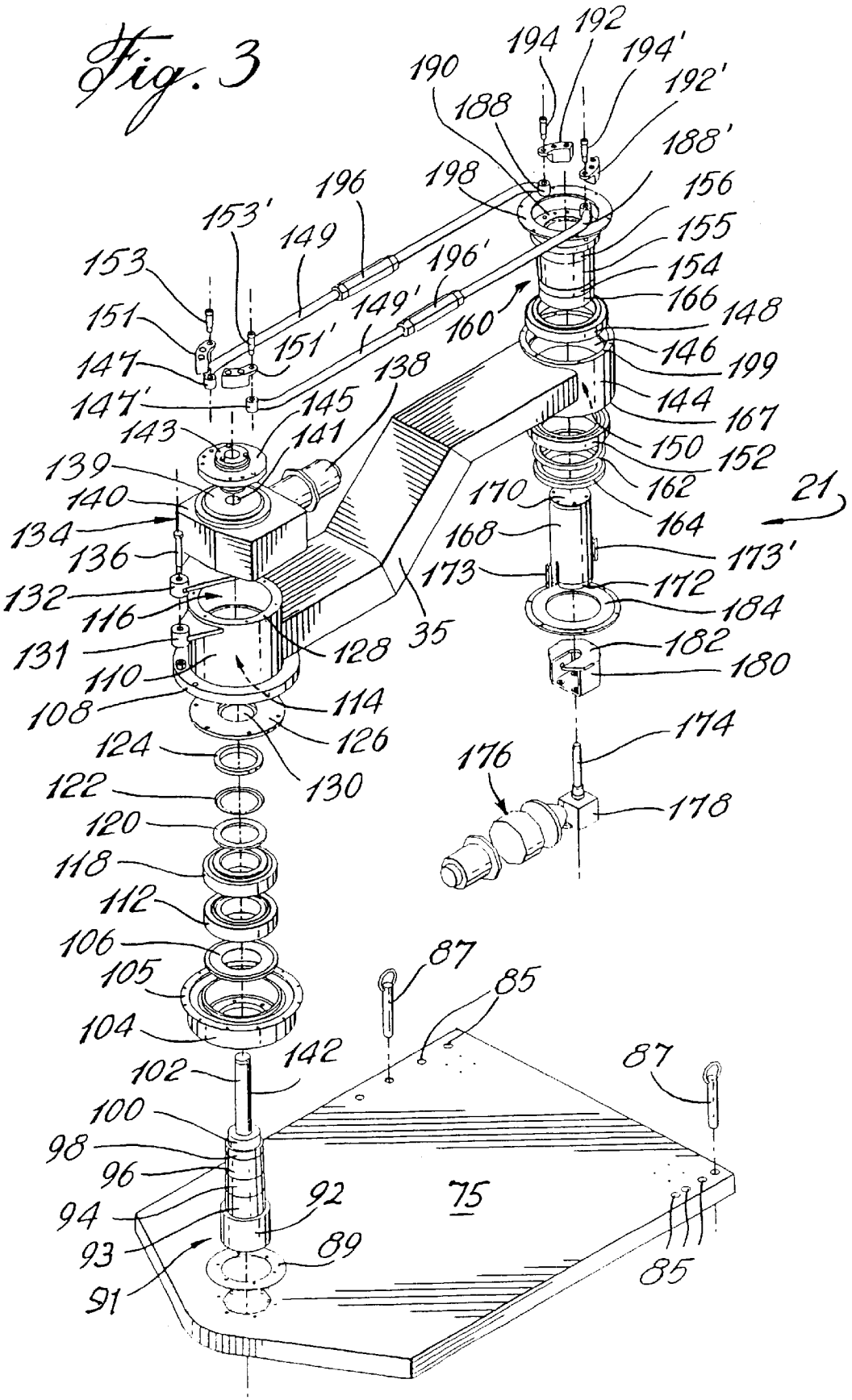
FIG. 3 is a left rear exploded view of the tool base provided on the embodiment of FIG. 1.

Turning now to FIG. 3, there is shown a detailed exploded view of the tool base provided in the first embodiment, wherein the control system and the various fasteners used in the assembly of the base are not shown for the sake of clarity. The base 21 comprises a foot plate 75 that can be provided with one or more bores 85 through which one or more dowels 87 may extend for engagement with corresponding receiving bores (not shown) provided in the floor. A vertically extending mount '91 bolted to the foot plate 75 with a spacer ring 89 comprises a lower portion 92 followed by a lower bearing engaging portion 93, a spacer portion 94, an upper bearing engaging portion 96, a threaded portion 98, an upper portion 100 and a shaft portion 102. Inserted into the first shouldered portion 92 is a pneumatic drum brake 104 of a conventional design for receiving an inflatable ring (not shown) connected to the air control system through hoses (not shown) and having a peripheral flanged portion 105 being adapted to mate with and be secured to a corresponding peripheral flanged portion 108 of a first hub portion 110 provided at a first end of the arm 35. Portions 92, 93, 94, 96, 98 and 100 of the mount 91 are of decreasing outer diameters for providing a plurality of shoulders as required for the bearings assembly, as well know in the art. Fitted round the lower bearing engaging portion 93 and over a fist ring 106 laying on the shoulder defined by portion 92 is a lower bearing 112 that is received into a lower recessed cavity formed within the hub portion 110 as indicated by arrow 114. Disposed round the second bearing engaging portion 96 and laying on the shoulder defined by portion 94 is an upper roller bearing 118 that is received into an upper recessed cavity 116 formed within the hub portion 110, over which appropriate rings 120 and 122 are disposed. The roller bearings assembly is then secured in position through a threaded ring 124 that is tightened on the receiving shouldered threaded portion 98. A cover plate 126 which is illustrated in FIG. 3 under the hub portion 110 for ease of the illustration is adapted to fit over the upper edge 128 of the hub portion 110 and is provided with a central recessed opening 130 adapted to receive a compliance ring (not shown) and through which extends the upper shouldered portion 100. The hub portion 110 is provided with an outwardly extending upper flange 131 adapted to mate with a corresponding similar flange 132 provided on a driving unit 134 for rigidly joining thereof with a bolt 136. The driving unit comprises a pneumatic reversible rotary motor 138 connected to the air control system through hoses (not shown) and coupled to a driven input of a speed reducing gear box contained within a driving unit casing 140 and having a driving output element attached thereto. The gear box has a stationary working element 139 being secured to the shaft 102 of mount 91 using a locking element (not shown) engaging with a longitudinal recess 142 provided on the shaft 102 extending through a bore 141 traversing the element 139. The end of the shaft 102 is rigidly secured with a collar 143 to a support plate 145 on which is mounted for rotation first ends 147 and 147' of a pair of adjustable pivoting members 149 and 149' using spacers 151 and 151' secured to the plate 145 and pivot rods 153 and 153'. The remote end of the arm 35 comprises a second hub portion 144 having an upper recessed cavity 146 for receiving a further upper roller bearing 148 and a lower recessed cavity as indicated by arrow 150 for receiving a further lower roller bearing 152. The roller bearings 148 and 152 are fitted round corresponding engaging portions 154 and 156 of a tubular rotor sleeve 160 axially extending through the second hub portion 144, the lower roller bearing 152 being in contact with a ring 162 and retained in position with a threaded ring 164 adapted to fit with a corresponding lower threaded portion 166 provided on the rotor sleeve 160. Roller bearings 112, 118, 148 and 152 such as those manufactured by Timken Co. (Canton, Ohio, USA) can be used. Upwardly and axially extending through the rotor sleeve 160 is a piston 168 having a push end plate 170 and a base end plate 172, and a pair of protruding rib members 173 and 173' laterally secured thereon and adapted to cooperate with corresponding grooves extending along the inner surface of rotor sleeve 160, to allow vertical movement of the piston 168 within the rotor sleeve 160 while preventing relative rotational movement therebetween. The piston push end plate 170 is rigidly secured to the underneath surface of the lower support plate 82 of the holder 32 as shown in FIG. 2. The base end plate 172 or the piston 168 is provided with a threaded hole vertically traversed by a driving shaft 174 of a pneumatic reversible rotary actuator generally designated at 176 connected to the air control system through hoses (not shown) and having a drive head 178 being secured within a casing 180 provided with a top mounting plate 182 that is rigidly bolted to the edge of rotor sleeve lower portion 166. A lower cover ring 184 is secured to [on] the lower edge 167 of the second hub portion 144. Second ends 188 and 188' of the pivoting member 149 and 149' are mounted for rotation on a flanged edge portion 190 of the rotor sleeve using spacers 192 and 192' secured to the edge portion 190 and pivot rods 194' 194'. A top cover ring 198 is secured on the top edge 199 of the second hub portion 144. Threaded sleeves 196 and 196' are used to adjust the respective length of the members 149 and 149' to allow alignment of the tool mounted on the holder 32 as shown in FIG. 2. When the arm 35 is pivoted either clockwise or counterclockwise from a central position where it is aligned with the tool in a working orientation, the members 149 and 149' apply a torque on the rotor sleeve 160 which rotates counterclockwise or clockwise respectively, causing the tool to keep its working orientation. It is pointed out that pivoting movement of the arm 35 provides further transversal displacement of the tool body 12 with reference to the base 21, while providing adjustment of the horizontal position of tool body 12 in a direction perpendicular to direction of the transversal displacement.

Figure 4:
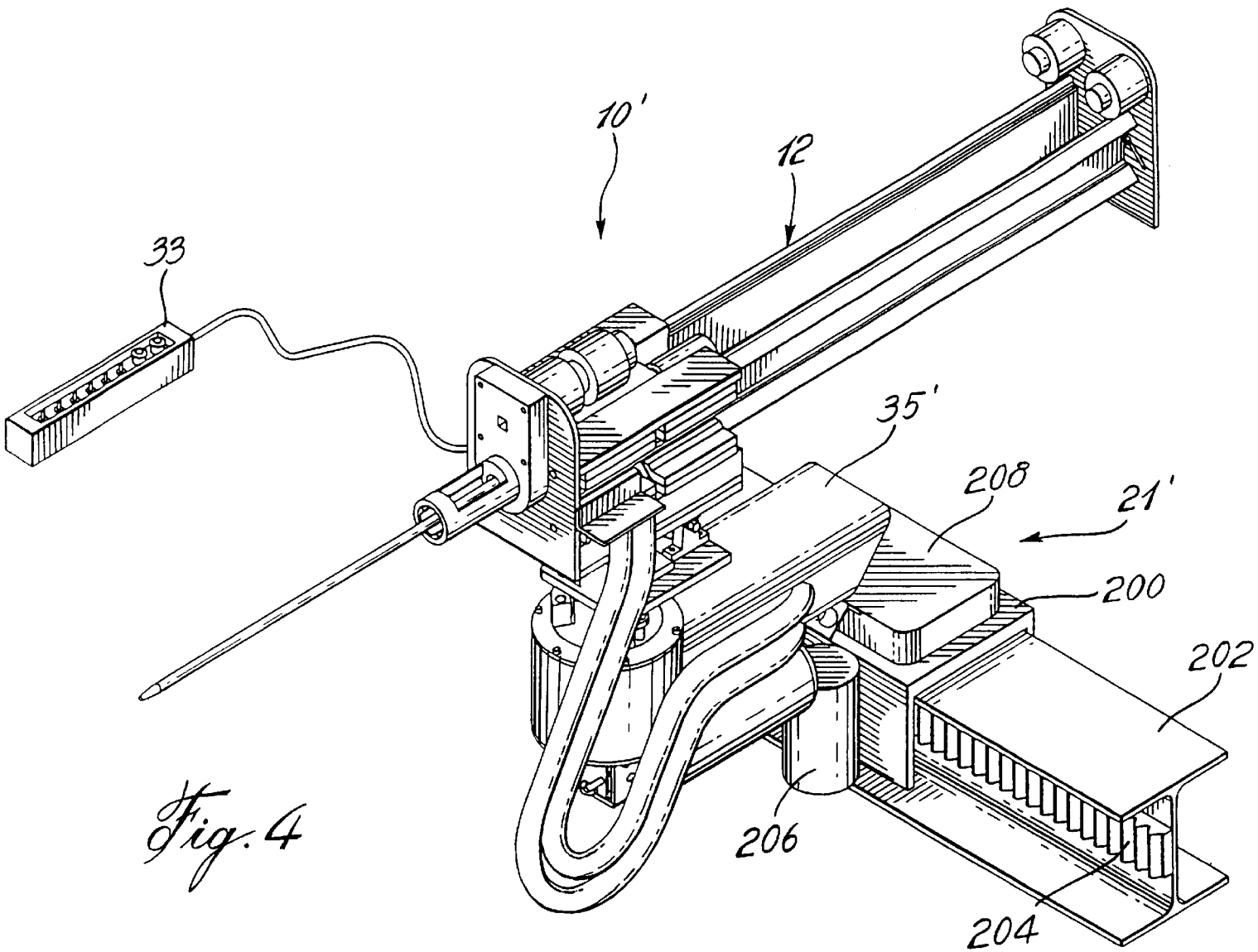
FIG. 4 is a perspective view of a second embodiment of an apparatus according to the invention which is mounted on a rail.

Referring now to FIG. 4, according to a second embodiment, the apparatus 10' includes a tool of a same design as the one described before with reference to FIG. 2, but without the optional low air pressure supply, and wherein the control system is integrated within the base arm 35'. While the remote end of the arm 35' is also of a similar design as the one described before, the first arm end 208 is rigidly secured to a carrier 200 as part of the base 21'. The carrier 200 is mounted for displacement along a longitudinal rail in the form of a I-beam 202 bearing on the ground, and preferably reinforced by lateral bracing members (not shown). The beam 202 is provided with lateral traction gears 204 adapted to cooperate with a corresponding drive (not shown) as part of the carrier and being powered by a pneumatic actuator 206 connected to the control system, thereby allowing adjustment of the horizontal position of the tool body 12 in a direction perpendicular to the direction of its transversal displacement.

Figure 5A:
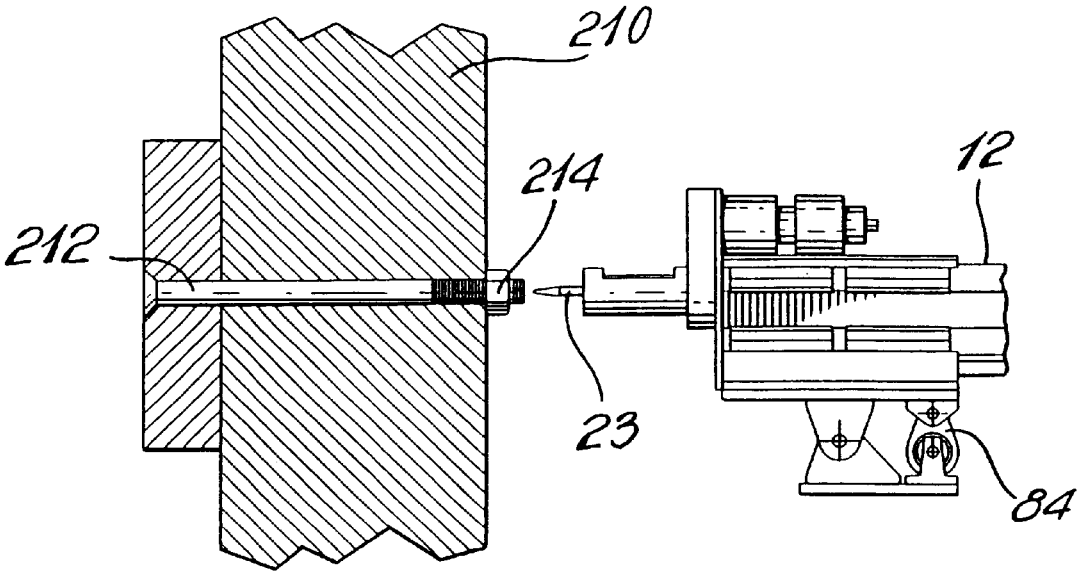
FIGS. 5*a* to 5*e* are partial side elevation views of the tool disposed adjacent a bolted structure shown in partial cross-section, showing the tool in distinct steps of the operation sequence.
Figure 5B:
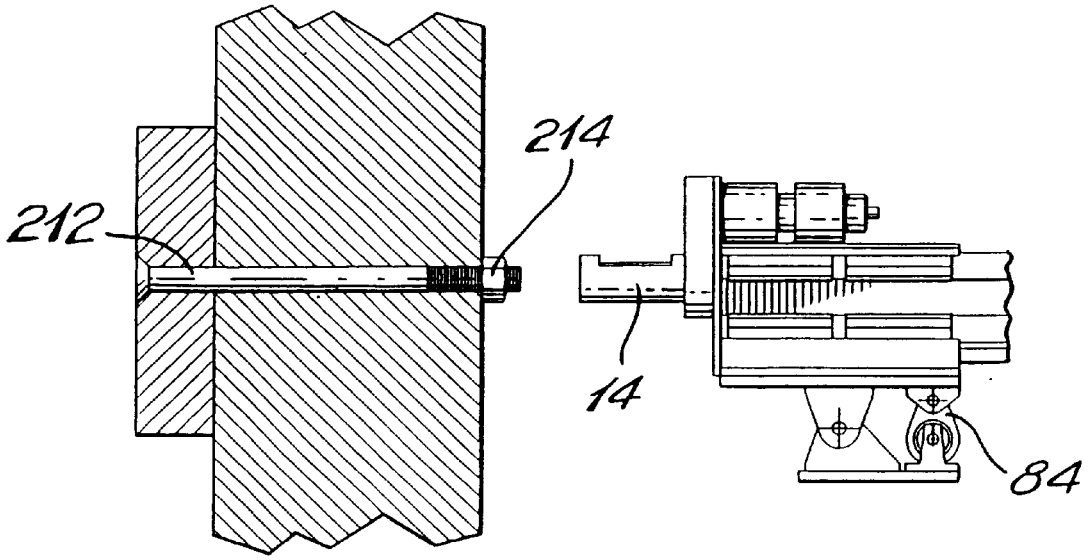
Figure 5C:
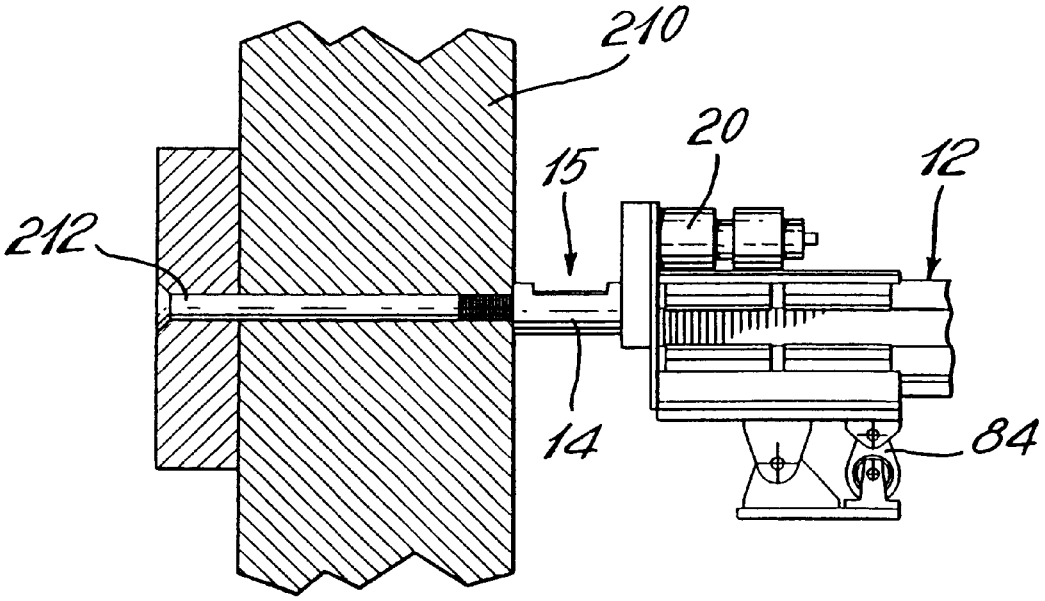
Figure 5D:
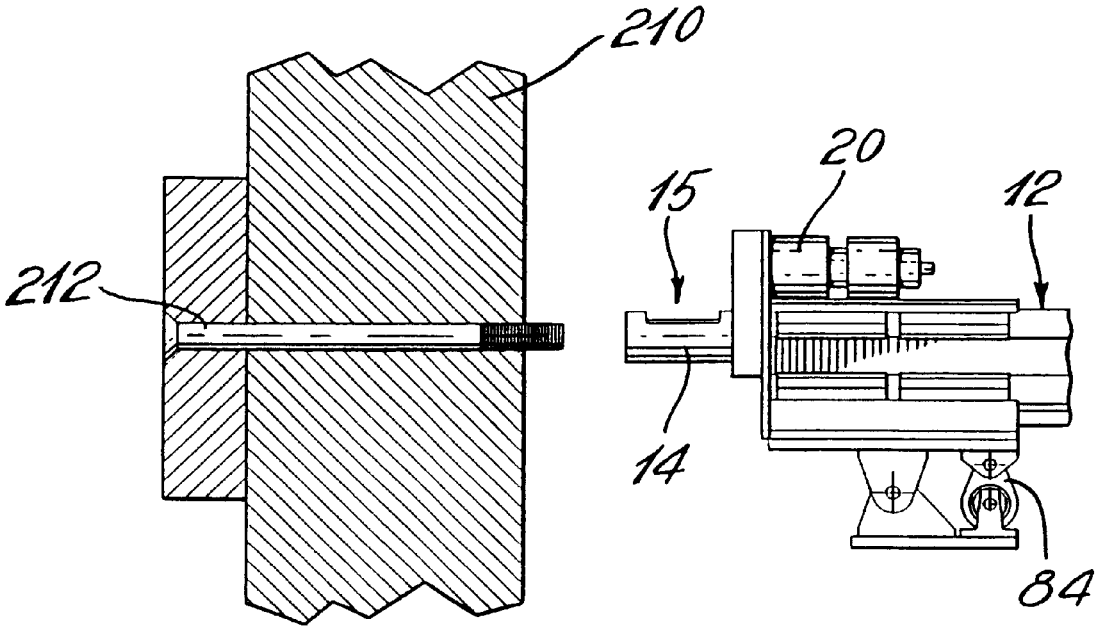
Figure 5E:
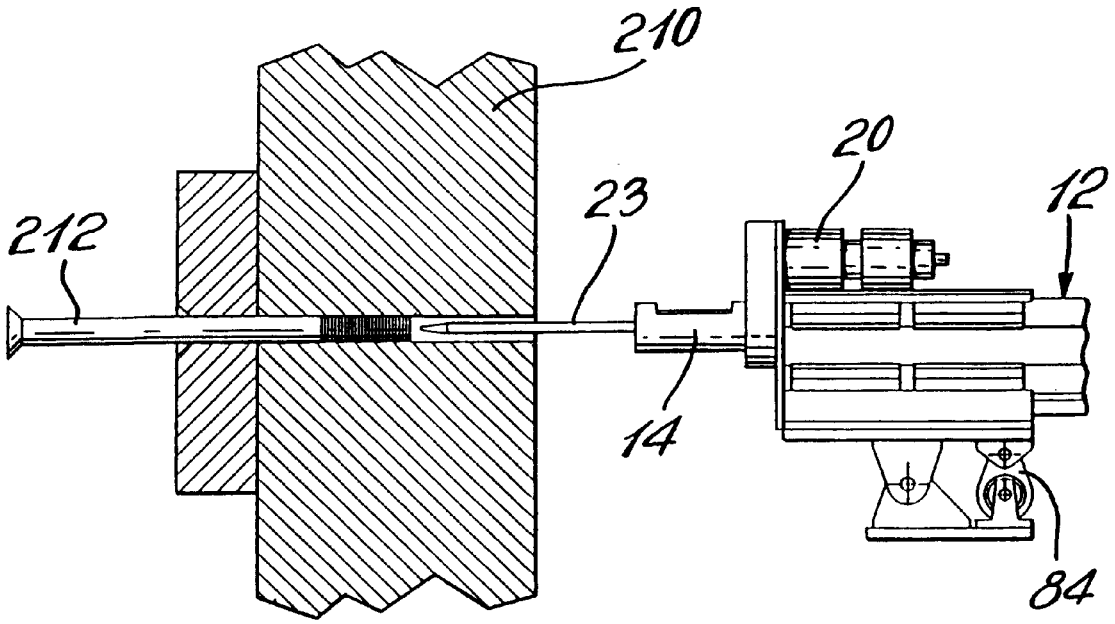

Turning now to FIGS. 1 2, 4, and 5*a* to 5*e*, operation of the apparatus according to the present invention will now be described. After the tool base has been disposed at a working distance of a structure 210 shown in cross-section and to which a bolt 212 is secured with a nut 214 mounted thereon, according to the first embodiment shown in FIG. 2, the control device 30 is used to cause either clockwise or counterclockwise rotation of the arm 35 to provide horizontal position adjustment of the tool body 12. Adjustment of relative angular position of the tool body 12 in a vertical plane with respect to the base 21 can also be manually made using the cam 83 of the tilt adjustment mechanism of the holder 32. According to the second embodiment shown in FIG. 4, the control device 30 is used to cause either left or right displacement of the carrier 200 along the beam 202 to provide horizontal position adjustment of the tool body 12. Then, for both embodiments, the control device 30 is used to cause the piston provided on the remote end of the arm 35 to either raise or go down to adjust vertical position of the tool body 12 in alignment with the nut 214. The control device 30 may then be used to proceed with a preliminary transversal approach of the front working portion of the tool body 12 toward the mounted nut 214 as shown in FIG. 5*a,* using the linear actuator provided on the tool body. During the preliminary positioning of the tool body 12, the push rod 23 may be brought through the socket 14 in a slightly extended position upon operation of the control device 30, to provide guiding for alignment with the nut, as shown in FIG. 5*a.* After the push rod 23 is brought in a fully retracted position as shown in FIG. 5*b,* the linear actuator of the tool body 12 is caused to further displace forward the front portion of the tool body 12 toward the nut, until the latter fully engage within the socket 14 as shown in FIG. 5*c.* The control device 30 is then used to cause rotation of the rotary actuator 20 for imparting torque to the mounted nut 212 in a direction allowing release of the nut from the secured bolt 212. Then, as shown in FIG. 5*d,* the linear actuator of the tool body 12 ca be commanded to displace rearward the front portion of the tool body 12, allowing easy withdrawal of the removed nut through the socket opening 15. It is to be understood that the socket may alternatively be maintained in the position shown in FIG. 5C while the nut is being withdrawn. Finally, the control device 33 is used to start the percussive motion of the power hammer while displacing forward the push rod 23 through the socket 14, thereby causing at least a partial withdrawal of the bolt 212 from the structure 210, as shown in FIG. 5*e.* It is to be understood that the socket may also be maintained in the position shown in FIG. 5*c* while the bolt is being withdrawn.

What is claimed is:

1. An apparatus for disassembling a threaded bolt and nut assembly, said bolt initially extending through an opening provided on a structure and being secured thereto with the nut axially mounted on a threaded rod of said bolt, said apparatus comprising:

a tool body;

a nut gripping element mounted for rotation on a working portion of said tool body, said gripping element being provided with a bore axially extending therethrough;

a rotary actuator mounted on the tool body and operatively coupled to the nut gripping element for imparting torque to the mounted nut in a direction allowing release of the nut from the secured bolt;

a pushing device mounted on the tool body and provided with an elongated push member having a working end being axially displaceable within the bore;

a linear actuator mounted on the tool body and operatively coupled to the pushing device for selectively displacing the push member between a retracted position allowing the release of the mounted nut and an extended position in contact with the bolt threaded rod to at least partially withdraw the bolt from said opening upon thrust of the working end of the push member;

means for controlling said rotary actuator and said linear actuator.

2. An apparatus according to claim 1, wherein said rotary actuator has a rotary output shaft extending in a parallel relationship with said elongated push member, said apparatus further comprising a mismatch coupling device mounted on said tool body and having a driven end input operatively receiving the rotary output shaft and a driving end output operatively connected to the nut gripping element to impart torque thereto while allowing the axial displacement of said push member through the driving end.

3. An apparatus according to claim 1, wherein said pushing device is a power hammer.

4. An apparatus according to claim 3, wherein said tool body defines a channel longitudinally extending therethrough and axially aligned with said bore to receive and allow displacement of said hammer through said channel upon the operation of said linear actuator, for causing said push member to be displaced between said retracted position and said extended position.

5. An apparatus according to claim 4, wherein said tool body is provided with guide means extending along said channel and corresponding slider means connected to said hammer and to a movable portion of said actuator.

6. An apparatus according to claim 1, wherein said nut gripping element is provided with a lateral opening to allow withdrawal of the nut after release thereof.

7. An apparatus according to claim 1, further comprising a base for supporting said tool body and a holder connecting said base to the tool body while allowing transversal displacement of the tool body with respect to the base.

8. An apparatus according to claim 7, wherein said holder is pivotally mounted on said base to allow adjustment of relative angular position of said tool body in a vertical plane with respect to said base.

9. An apparatus according to claim 7, wherein said base is provided with means for adjusting horizontal position of said tool body in a direction perpendicular to the direction of said transversal displacement.

10. An apparatus according to claim 7, wherein said base is provided with means for adjusting vertical position of said tool body.

11. An apparatus according to claim 7, wherein said apparatus further comprises:

a further linear actuator rigidly connected to the holder and operatively coupled to said main body to provide the transversal displacement of said tool body on the holder between a tool body retracted position and a tool body extended position;

means to control said further linear actuator.

12. An apparatus according to claim 11, wherein said tool body is provided with guide means extending along said channel and corresponding slider means connected to said holder to allow said displacement.

* * * * *